US005205200A

United States Patent [19]

Wright

[11] Patent Number: 5,205,200

[45] Date of Patent: Apr. 27, 1993

[54] HYDRAULIC BOOSTER DEVICE FOR LINEAR ACTUATOR

[76] Inventor: John J. Wright, 9 Hix Ave., Rye, N.Y. 10580

[21] Appl. No.: 818,300

[22] Filed: Jan. 9, 1992

Related U.S. Application Data

[63] Continuation-in-part of Ser. No. 558,228, Jul. 26, 1990.

[51] Int. Cl.[5] ..... F01B 25/26

[52] U.S. Cl. ..... 91/1; 92/62; 92/113; 92/162 R; 91/DIG. 4

[58] Field of Search ..... 92/113, 62, 65, 15 R, 92/162 R, 110, 111; 91/1, DIG. 4

[56] References Cited

U.S. PATENT DOCUMENTS

| | | | |
|---|---|---|---|
| 2,688,313 | 9/1954 | Bauer | 92/111 |
| 2,918,903 | 12/1959 | Geyer | 92/111 |
| 3,168,853 | 2/1965 | Prince | 92/62 |
| 3,208,354 | 9/1965 | Topinka | 92/62 |
| 3,403,365 | 9/1968 | Richards | 92/5 R |
| 4,218,960 | 8/1980 | Bourges | 92/113 |

FOREIGN PATENT DOCUMENTS

| | | | |
|---|---|---|---|
| 2633177 | 1/1978 | Fed. Rep. of Germany | 92/62 |
| 1155231 | 4/1958 | France | 92/62 |
| 0136177 | 11/1978 | Japan | 92/62 |
| 0579458 | 11/1977 | U.S.S.R. | 92/62 |
| 911709 | 11/1962 | United Kingdom | 92/62 |

*Primary Examiner*—Edward K. Look
*Assistant Examiner*—Hoang Nguyen

[57] ABSTRACT

A linear actuator used in moving, for example, gate valves, sluice gates and the like, wherein an increased thrust is required during initial movement. The present invention includes, as part of the linear actuator, a novel booster piston movably disposed about a piston rod; further included on the booster piston is a thrust column disposed radially between the booster piston and the piston rod so as to define an annular fluid channel for enabling fluid to move upwardly so as to contribute a substantial additional thrust component to move the primary piston.

11 Claims, 2 Drawing Sheets

HYDRAULIC BOOSTER DEVICE FOR LINEAR ACTUATOR

This is a continuation-in-part of application Ser. No. 558,228, filed Jul. 26, 1990. The benefit of the filing data of the parent application as to all common subject matter is herewith claimed.

The present invention relates generally to a linear actuator used in moving, for example, gate valves and sluice gates, where an increased thrust is required during the initial movement of the valve. More particularly, the present invention is a novel booster piston movably disposed about a piston rod of a linear actuator which is capable of providing additional thrust to a piston.

BACKGROUND OF THE INVENTION

Linear actuators comprising piston means displaced by fluid or air pressure are typically used to control the opening and closing of valves, e.g., gate valves and sluice gates. One of the principal problems encountered in providing actuators of this type to control valves results from the fact that the force required to break the seal upon opening the valve is generally considerably greater than that necessary at any other portion of the opening or closing cycle. This relatively large force is commonly referred to as the "break-away" force and is caused by friction of the valve disk against the valve seat on opening.

Another problem results from the fact that when the final closing force is too large, the valve may slam shut causing distortion of the parts and damage to the seals.

Various actuators have been designed with the purpose of overcoming the "break-away" force by supplying an initial larger force. U.S. Pat. Nos. 2,896,413 (Hussey), which issued Jul. 28, 1959, and 3,208,354 (Topinka), which issued Sep. 28, 1965, both disclose fluid actuators having means for providing a large initial force capable of overcoming the friction forces involved in breaking a valve seal or moving an object. Furthermore, both the Hussey and Topinka patents use auxiliary pistons to generate the large initial force.

The Hussey patent provides a working piston which provides the principal opening and closing force and an auxiliary piston which provides a supplemental force during the initial part of the opening cycle and which also acts as a buffer during the final portion of the closing cycle. An operating fluid enters an annular chamber and flows into a compartment adjacent to the primary piston. The fluid adjacent to the primary piston then flows from that compartment into another compartment adjacent the auxiliary piston by means of a conduit within the auxiliary piston. The force of the fluid pressure in the compartments acting against the pistons urges them both to the right.

The Topinka patent discloses a dual motor having both a large diameter piston and a small diameter piston for actuation of a single piston rod. The Topinka patent differs from the Hussey patent in that its fluid receiving chambers for the large and small pistons are isolated from each other so as to adapt the motor for various modes of operation. That is, fluid is pumped into separate isolated chambers associated with each piston in order to actuate the piston rod. With the pistons being isolated from each other within the motor housing, an on-off valve may be install within the conduit line supplying fluid to the auxiliary piston and when closed will prevent fluid from being delivered to that piston.

Conventional dual piston designs can cause the primary piston to move before it receives the benefit of the thrust generated from the auxiliary piston. That is, the Hussey patent supplies fluid to the compartment associated with the primary piston and then from that compartment to the compartment associated with the auxiliary piston. The Topinka patent includes isolated chambers wherein it may also supply fluid to the primary piston prior to the auxiliary piston depending upon the efficiency of its fluid delivery system.

The present invention also provides many additional advantages which shall become apparent as described below.

SUMMARY OF THE INVENTION

The present invention provides a unique integrated booster piston design which does not require additional lengthening of the housing or separate isolated fluid compartments necessitating additional ports and a sophisticated fluid delivery system. That is, the novel booster piston of the present invention is disposed about the piston rod to permit the rod to travel through the booster piston and thrust column in both directions, while providing a compact dual piston design.

Furthermore, the present invention is designed such that the fluid or air pressure acts upon the booster piston prior to the primary piston so that the initial thrust on the piston rod is, in fact, the combined thrust of both pistons.

A primary feature of the present invention is a linear actuator comprising: a housing having a primary piston chamber and a booster piston chamber; a piston rod disposed within the housing; a primary piston secured to one end of the piston rod and disposed within the primary piston chamber, the primary piston chamber having a first primary compartment and a second primary compartment disposed on opposite sides of the primary piston; a booster piston movably disposed about the piston rod and within the booster piston chamber, the booster piston chamber having a first booster compartment and a second booster compartment disposed on opposite sides of the booster piston; a thrust column attached to the booster piston and disposed radially between the booster piston and the piston rod so as to define an annular fluid channel extending axially between the booster and primary compartments; and first and second axial passageways connecting the first port to points directly below the annular channel and the bottom surface of the booster piston respectively; a first port capable of simultaneously supplying or draining fluid or air to or from the first primary compartment and the first booster compartment, wherein the first primary compartment and the first booster compartment are in contact via a fluid or air channel disposed between the thrust column and the piston rod; a second port capable of supplying and draining fluid or air to or from the second primary compartment; and a third port capable of supplying and draining fluid or air to or from the second booster compartment.

Other and further objects, advantages and features of the present invention will be understood by reference to the following specification in conjunction with the annexed drawings, wherein like parts have been given like numbers.

DESCRIPTION OF PREFERRED EMBODIMENTS

The design of the present invention insures that a booster piston associated with a linear actuator is actuated such that its thrust is always applied to a primary piston during retraction of an associated piston rod. The present inventor has developed a novel linear actuator which includes a booster piston which, although independent from the primary piston, is displaced by fluid or air which simultaneously acts on the primary piston. The simultaneous thrusts either directly exerted by the thrust column affixed to the booster piston upon the primary piston or by the fluid or air transmitted to the primary piston increases the total thrust upon the associated piston rod by approximately 50–60% over conventional single piston devices.

This novel linear actuator increases the thrust during the initial movement of the piston rod within the first inch or so when the highest thrust, i.e., "break-out", is required in many linear applications, such as gate valves and sluice gates. The increase of thrust is accomplished by putting a booster or auxiliary piston about the piston rod or, if desired, at the piston end. Additional thrust is obtained by supplying high pressure air or oil to the booster piston and primary piston simultaneously. Typically, the booster piston has a thrust of 20 psi and the primary piston has a thrust of 30 psi, which generate a combined initial thrust of 50 psi.

The booster piston is independent of the primary piston and disposed about the piston rod. A center thrust column affixed to the booster piston and disposed between the booster piston and the piston rod pushes against the bottom of the primary piston during the initial retraction of the piston rod. The piston rod travels through the thrust column affixed to the booster piston in both directions and is separate from the booster piston.

During initial retraction of the piston rod, fluid or air is supplied to both the booster piston and the primary piston via the same port. The fluid displaces the booster piston which causes the thrust column to push against the bottom of the primary piston. Therefore, an initial combined thrust caused by the pushing of the fluid and thrust column against the bottom of the primary piston acting in concert produce an increased initial thrust upon the piston rod. The booster piston only operates for approximately 1–2 inches, although it may be designed to operate for any desired distance depending upon the particular requirements of the actuator.

Figure 1:
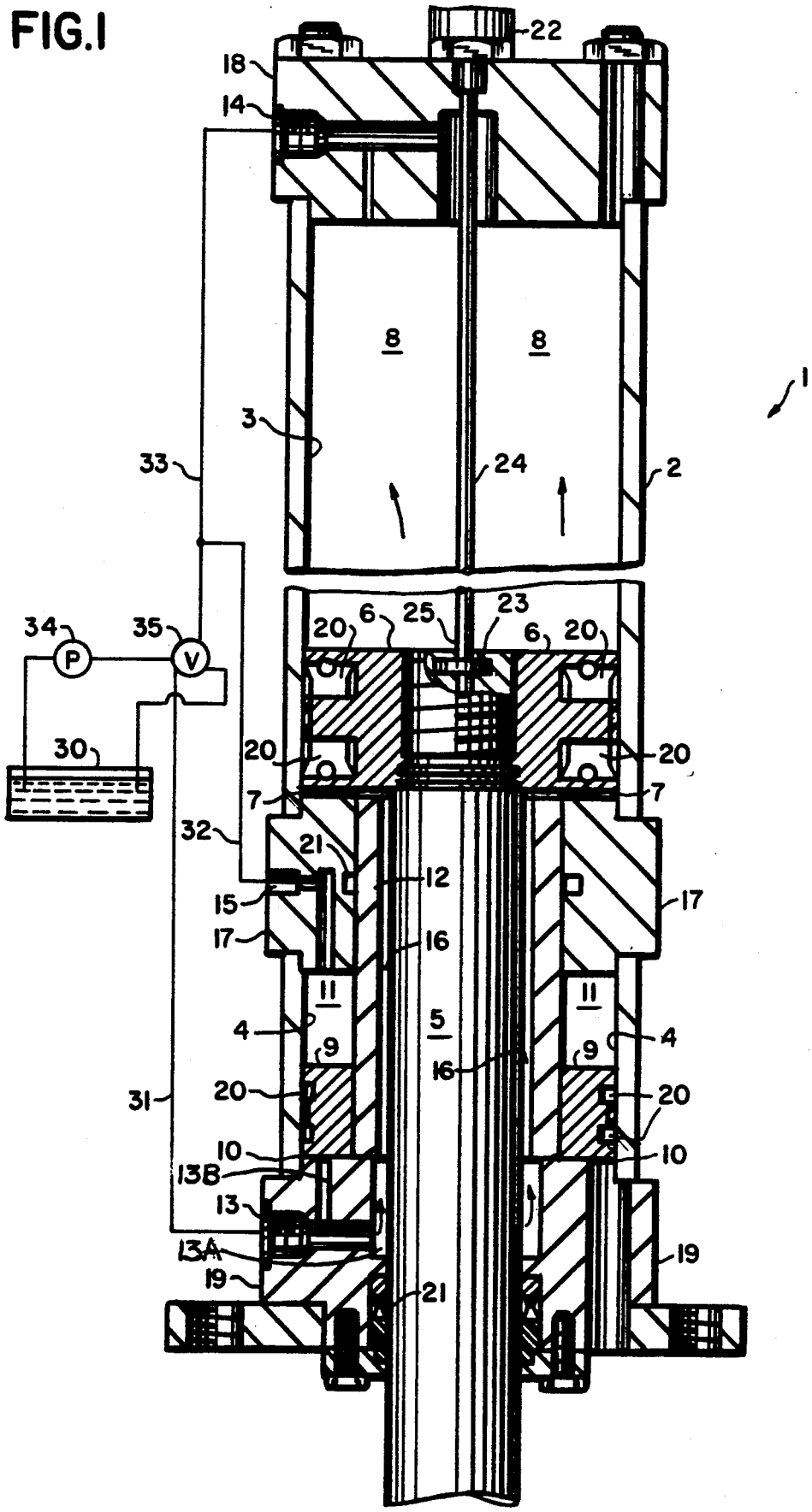
FIG. 1 is a schematic cross-sectional view of a linear actuator of the present invention with the piston rod in the fully extended position.

The present invention can further be described while referring to the attached drawings, wherein FIG. 1 depicts a linear actuator 1 comprising: a housing 2 having a primary piston chamber 3 and a booster piston chamber 4. A piston rod 5 is disposed within housing 2, wherein a primary piston 6 is secured to one end of piston rod 5 and disposed within primary piston chamber 3. As shown in FIG. 1, piston 5 is in a fully extended position within housing 2. Primary piston chamber 3 includes a first primary compartment 7 and a second primary compartment 8 disposed on opposite sides of primary piston 6.

A booster piston 9 is movably disposed about piston rod 5 and within booster piston chamber 4. Booster piston chamber 4 includes a first booster compartment 10 and a second booster compartment 11 disposed on opposite sides of booster piston 9. A thrust column 12 is attached to booster piston 9 and radially between booster piston 9 and piston rod 5. Thus, an annular channel 16 is defined between the thrust column 12 and piston rod 5 for enabling fluid flow upwardly from the first booster compartment 10 to the first primary compartment 7 in the "upward mode" for the booster piston 9, i.e., when it is contributing thrust, by dint of the attached thrust column 12, to aid the "break-away" of the main piston rod 5.

Linear actuator 1 also includes means for supplying and draining fluid or air to primary piston chamber 3 and booster piston chamber 4. Such means include first port 13, second port 14 and third port 15. First port 13 is capable of supplying or draining fluid to or from first primary compartment 7 and first booster compartment 10 concurrently, inasmuch as first primary compartment 7 and first booster compartment 10 are in fluid contact via the annular channel 16 disposed between thrust column 12 and piston rod 5. To enable a precisely directed, copious parallel flow of fluid (oil), a first axial passageway 13A connects the first port 13 to a point within the booster piston chamber 4 (compartment 10) aligned with, and directly below the annular channel 16; further, a second axial passageway 13B formed in plate connects the first port 13 directly to a point below the bottom surface of booster piston 9.

A second port 14 is capable of supplying and draining fluid to or from second primary compartment 8 and a third port 15 is capable of supplying and draining fluid to or from second booster compartment 11.

Intermediate plate or head 17 is disposed between primary piston chamber 3 and booster piston chamber 4, whereby intermediate plate 17 restricts both the vertical movement of primary piston 6 during extension of piston rod 5 and the vertical movement of booster piston 9 during retraction of piston rod 5. Blind end plate or head 18 is disposed within housing 2 such that it restricts the vertical movement of primary piston 6 during retraction of piston rod 5. Rod end plate or head 19 is disposed within housing 2 such that it restricts the vertical movement of booster piston 9 during extension of piston rod 5.

Third port 15 is disposed within intermediate plate 17, second port 14 within blind end plate 18 and first port 13 within rod end plate 19.

To provide a fluid seal between housing 3, primary piston 6 and booster piston 9, each piston includes piston seals 20. Furthermore, rod seals 21 are disposed on intermediate plate 17 and rod end plate 19 to provide a fluid seal within actuator 1.

Figure 2:
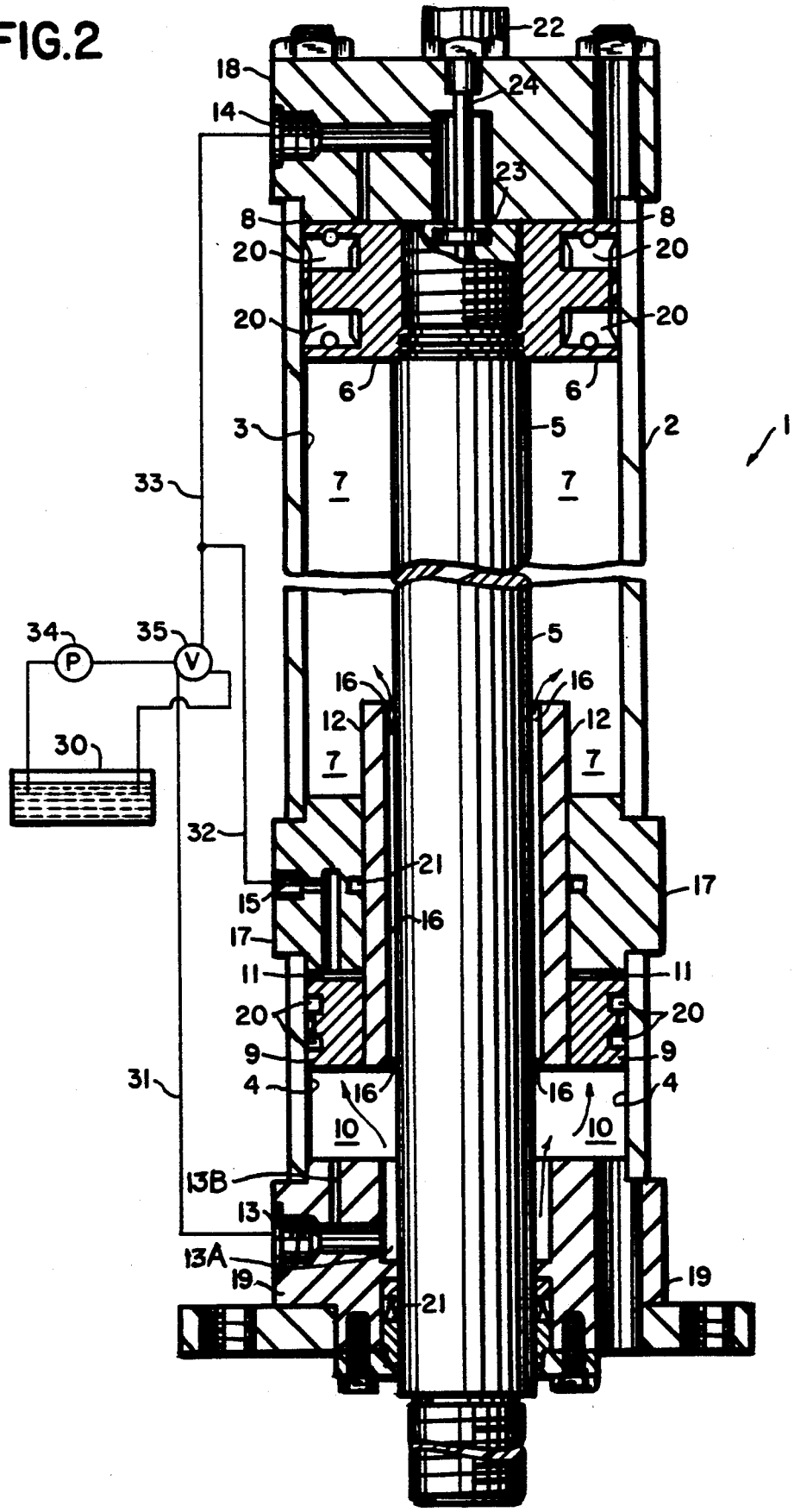
FIG. 2 is a schematic cross-sectional view of a linear actuator of the present invention with the piston rod in the fully retracted position.

It will be seen that a linear transducer 22 is provided to indicate the extent to which the main piston has moved upwardly (FIG. 2). An LED (not seen) forms part of transducer 22 which also comprises a magnet 23, within primary piston 6, whose movement relative to a conduit 24, which is held within a bore 25, formed in rod 5, causes generation of appropriate signals representative of distance traveled by piston 6. Such signals are applied to the LED to display the distance that piston 6, and therefore the gate valve, has moved. Such arrangement of a transducer is advantageous in that it obviates the need for limit switches and the like, which are totally inadequate in that they will not stand up in use.

The operation of actuator 1 can best be described while referring to both FIGS. 1 and 2, wherein FIG. 1 depicts piston 5 in a fully extended position (downward) and FIG. 2 depicts piston 5 in a fully retracted position. In order to increase the initial thrust on piston rod 5 of linear actuator 1 fluid or air must be supplied from a reservoir 30 concurrently into first booster compartment 10 and first primary compartment 7 by means of pipe 31, first port 13, and annular channel 16.

Booster piston 9 is displaced by supplying the fluid or air into first booster compartment 10, while draining through third port 15 a proportionate quantity of fluid or air from second booster compartment 11. The drained fluid is returned to reservoir 30 via pipes 32 and 33. As booster piston 9 is displaced under fluid or air pressure it contacts the bottom of primary piston 6 with an end of thrust column 12.

Primary piston 6 is thereafter displaced by the application of the combined force generated from the contacting of primary piston 6 with thrust column 12 and the fluid or air pressure exerted by the supply of fluid or air into first primary compartment 7. A proportionate quantity of fluid or air as that introduced into first primary compartment 7 is drained through second port 14 from second primary compartment 8. The fluid drained from fluid second port 14 is returned to reservoir 30 via pipe 33. The supply and drainage of the fluid or air is controlled by means of a pump 34 and a bidirectional valve 35.

Conversely, when piston rod 5 is to be extended, as shown in FIG. 1, fluid or air is supplied from reservoir 30 to second primary compartment 8 via second port 14 and pipe 33. As the fluid enters second primary compartment 8, causing piston 6 to move downward, a proportionate quantity of fluid is drained and returned to reservoir 30 from first primary compartment 7 and first booster compartment 10 via first port 13 and pipe 31. Fluid or air is also supplied to second booster compartment 11 via third port 15 in an amount proportionate to that drained from first booster compartment 10. Optionally, first booster compartment 10 may also be drained by means of primary piston 6 pushing against thrust column 12 which in turn forces fluid from first booster compartment 10. In this instance, fluid would be supplied to second booster compartment 11 by means of the suction caused by the retraction of booster piston 9 within booster piston chamber 4.

In order to enable the man skilled in the art to practice the present invention most proficiently, a detailed set of specifications is provided herewith, particularly with reference to components that contribute importantly to supplying the upwardly directed (retraction mode) forces to the main piston for overcoming the frictional forces involved when a valve "seal" is to be broken. It will be appreciated by those skilled in the art that the size of the annular fluid channel 16 to be realized in the apparatus or device of the present invention is of great significance. The following dimensions for the various components in achieving that end is herewith provided:

Piston rod diameter=3,000 inches
Main and Booster Piston O.D.=7.015/7.012 inches
Main Piston I.D.=4.128/4.126 inches
thrust column height=8.000 inches
thrust column O.D.=4,500 inches
thrust column I.D.=3,250 inches It will be appreciated from the above-noted dimensions for the various parts, that the selected ratio between the inner diameter of the thrust column 12 and the diameter of the solid piston rod 5 is approximately 1.08. Such ratio would be adhered to if either a smaller or larger size device were being manufactured. In the specific instance of the solid piston rod 5 having a 3 inch diameter, a flow channel of 0.250 inches in radial width is provided around the rod, through which channel the oil can flow readily.

It will thus be understood from the above that a complete annular circumference of 360 degrees is involved, rather than a spaced series of passageways or channels. In other words, a full unitary, annular channel 16 exists. What this means is that, with a 15 lbs. per square inch pressure drop at a typical flow rate of 11 feet per second, approximately 50 gallons of fluid will pass through the approximately 1.23 square inches of area in the annular channel 16, which is indeed a very copious flow for the purpose of driving the main piston 6 in the device of the present invention.

While I have shown and described several embodiments in accordance with my invention, it is to be clearly understood that the same are susceptible to numerous changes apparent to one skilled in the art. Therefore, I do not wish to be limited to the details shown and described by intend to show all changes and modifications which come within the scope of the appended claims.

I claim:

1. A linear actuator comprising:

a pressurized fluid supply;

a housing having a primary piston chamber and a booster piston chamber;

a piston rod disposed within said housing;

a primary piston secured to one end of said piston rod and disposed within said primary piston chamber, said primary piston chamber having a first primary compartment and a second primary compartment disposed on opposite sides of said primary piston;

a booster piston movably disposed about said piston rod within said booster piston chamber, said booster piston chamber having a first booster compartment and a second booster compartment disposed on opposite sides of said booster piston;

a thrust column, affixed to said booster piston and movable relatively axially with respect to the piston rod, for pushing directly against said primary piston, responsive to the pressurized supply of fluid to the first booster compartment, which fluid acts against the bottom of said booster piston, so as to provide an initial thrust component to said piston rod, said thrust column being disposed radially between said booster piston and said piston rod so as to define an annular fluid channel extending axially between said first booster compartment and said first primary compartment for enabling said fluid to move therebetween, thereby to contribute a substantial additional thrust component to move said primary piston;

a first port, located below the extreme point of travel of said booster piston, when the piston rod is fully extended, said port extending radially in fluid communication with said first booster compartment, thereby to be capable of supplying or draining said fluid to or from said first primary compartment and said first booster compartment concurrently;

a second port capable of supplying and draining fluid to or from said second primarly compartment; and a third port capable of supplying and draining fluid to or from said second booster compartment; and, in which, to enable a precisely directed, copious parallel flow of pressurized fluid, said device includes a first axial passageway which connects the first, radially extending port to a point in said first booster compartment immediately adjacent and aligned with said annular fluid channel when the piston rod is fully extended, and further includes a second axial passageway spaced radially from the first axial passageway which connects the first port to a point in said first booster compartment immediately adjacent said booster piston bottom surface when the piston rod is fully extended.

2. A device as defined in claim 1, in which the ratio of the inner diameter of the thrust column to the outer diameter of said piston rod is approximately 1.08.

3. A device as defined in claim 2, in which the inner diameter of said thrust column is approximately 3.25 inches, and the outer diameter of said piston rod is approximately 3.0 inches, whereby said defined annular fluid channel has a radial width of approximately 0.25 inches, corresponding to a total area of approximately 1.23 square inches.

4. The linear actuator according to claim 1, wherein a first plate is disposed between said primary piston chamber and said booster piston chamber, whereby said plate restricts both the axial movement of said primary piston during extension of said piston rod and the axial movement of said booster piston during retraction of said piston rod.

5. The linear actuator according to claim 4, wherein a second plate is disposed within said housing such that it restricts the axial movement of said primary piston during retraction of said piston rod.

6. The linear actuator according to claim 5, wherein a third plate is disposed within said housing such that it restricts the axial movement of said booster piston during extension of said piston rod.

7. The linear actuator according to claim 4, wherein said third port is disposed within said first plate.

8. The linear actuator according to claim 5, wherein said second port is disposed within said second plate.

9. The linear actuator according to claim 6, wherein said first port is disposed within said third plate.

10. The linear actuator according to claim 1, wherein a linear transducer attached to one end of said housing measures the movement of said piston rod.

11. The linear actuator according to claim 10, wherein said linear transducer incudes a magnet disposed within said primary piston and a conduit extending within a bore formed in said piston rod.

* * * * *